US007560634B2

(12) United States Patent
Miyazawa

(10) Patent No.: US 7,560,634 B2
(45) Date of Patent: Jul. 14, 2009

(54) ELECTRONIC MUSICAL INSTRUMENT HAVING TUNING DEVICE

(75) Inventor: Kenichi Miyazawa, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 0 days.

(21) Appl. No.: 11/623,970

(22) Filed: Jan. 17, 2007

(65) Prior Publication Data

US 2007/0169612 A1 Jul. 26, 2007

(30) Foreign Application Priority Data

Jan. 20, 2006 (JP) ..... 2006-011957

(51) Int. Cl.
*G10G 7/02* (2006.01)
*G10H 1/44* (2006.01)

(52) U.S. Cl. ..... 84/454

(58) Field of Classification Search ..... 84/454
See application file for complete search history.

(56) References Cited

U.S. PATENT DOCUMENTS

| | | | | |
|---|---|---|---|---|
| 4,429,609 | A * | 2/1984 | Warrender | 84/454 |
| 4,484,506 | A * | 11/1984 | Sato | 84/601 |
| 4,915,007 | A * | 4/1990 | Wachi et al. | 84/622 |
| 4,947,724 | A * | 8/1990 | Hirano et al. | 84/631 |
| 5,461,189 | A * | 10/1995 | Higashi et al. | 84/601 |
| 5,504,269 | A * | 4/1996 | Nagahama | 84/609 |
| 5,760,326 | A * | 6/1998 | Ishibashi | 84/626 |
| 5,847,302 | A * | 12/1998 | Morikawa et al. | 84/603 |
| 6,288,313 | B1 * | 9/2001 | Sato et al. | 84/177 |
| 7,161,080 | B1 * | 1/2007 | Barnett | 84/613 |
| 7,169,996 | B2 * | 1/2007 | Georges et al. | 84/609 |
| 7,217,878 | B2 * | 5/2007 | Ludwig | 84/609 |
| 7,268,286 | B2 * | 9/2007 | Carpenter | 84/454 |
| 7,271,329 | B2 * | 9/2007 | Franzblau | 84/609 |
| 2007/0169612 | A1 * | 7/2007 | Miyazawa | 84/423 R |
| 2007/0186752 | A1 * | 8/2007 | Georges et al. | 84/609 |
| 2008/0229906 | A1 * | 9/2008 | Kwak et al. | 84/454 |
| 2009/0031879 | A1 * | 2/2009 | Everly | 84/454 |

FOREIGN PATENT DOCUMENTS

JP 6-40262 B2 5/1994

OTHER PUBLICATIONS

Machine Translation JP H06-040262 (1994) to Yamaha, rendered to pdf Feb. 22, 2008.*
Tuning Your Guitar (using a keyboard), Catherine Schmidt-Jones, Oct. 3, 2007.*
"Acoustics of Musical Instruments"; Published by Ongaku-no-tomo Co. Ltd. (pp. 54-64), Oct. 30, 1971.

* cited by examiner

*Primary Examiner*—Jeffrey Donels
*Assistant Examiner*—Robert W Horn
(74) *Attorney, Agent, or Firm*—Dickstein Shapiro LLP

(57) ABSTRACT

An electronic musical instrument includes a tuning device, a keyboard, a tone generator, a microphone, a measurement unit, and a display attached to the backside of the housing. The tone generator generates a plurality of reference tones in response to the operation of the keyboard, while the microphone receives a plurality of musical tones, which are generated by at least one musical instrument subjected to tuning. Different tone colors can be applied to the reference tones. The measurement unit measures a plurality of pitch differences between the reference tones and the musical tones subjected to tuning, so that the display displays the pitch differences in comparison with each other.

8 Claims, 6 Drawing Sheets

ELECTRONIC MUSICAL INSTRUMENT HAVING TUNING DEVICE

BACKGROUND OF THE INVENTION

1. Field of the Invention

The present invention relates to electronic musical instruments having tuning devices, which are suitable for musical practice played in an ensemble.

This application claims priority on Japanese Patent Application No. 2006-11957, the content of which is incorporated herein by reference.

2. Description of the Related Art

Japanese Examined Patent Application Publication No. H06-40262 teaches an example of an electronic musical instrument having a tuning device, i.e., an electronic keyboard instrument having a tuning device, in which a reference tone used for tuning is produced upon depression of a key of a desired tone pitch. When a player plays a musical instrument subjected to tuning by listening to the reference tone, the electronic musical instrument detects a musical tone, which is actually produced by playing the musical instrument, by means of a microphone, a pitch difference is detected between the actually produced musical tone and the reference tone and is then displayed on a display screen. The aforementioned electronic musical instrument having the tuning device is used to notify the player of a musical instrument subjected to tuning of the frequency of a reference tone and a musical tone subjected to tuning.

A book entitled "Acoustics of Musical Instruments", which was written by Mr. Yoshinori Ando and was published by Ongaku-no-tomo Co. Ltd. (see pages 54-64) on Oct. 30, 1971, teaches acoustics regarding roots and overtones produced by wind instruments and brass instruments.

However, none of the conventionally-known electronic musical instruments having tuning devices including the aforementioned electronic musical instrument have a notification means for effectively notifying a player of a musical instrument subjected to tuning of a pitch difference between a reference tone and an actually produced musical tone. That is, it is necessary for the user of a conventionally-known electronic musical instrument to notify the player of a musical instrument subjected to tuning of pitch differences; but this is very inefficient.

Some of the conventionally-known tuning devices, which are provided independently of the conventionally-known electronic musical instruments, have a relatively large display; however, it is very troublesome for the users of tuning devices to set up reference tones because they do not have functions allowing users to set up frequencies of reference tones upon depression of keys.

SUMMARY OF THE INVENTION

It is an object of the present invention to provide an electronic musical instrument having a tuning device, which allows a user to easily set up frequencies of reference tones and which has a function to effectively notify a player of a musical instrument subjected to tuning of pitch differences between reference tones and musical tones actually produced by a musical instrument subjected to tuning.

According to the present invention, an electronic musical instrument having a tuning device includes a keyboard having a plurality of keys for designating a plurality of reference tones, a tone generator for generating the reference tones, which are designated by operating the keyboard, a microphone for collecting at least one sound, which is generated by at least one musical instrument, a measurement unit for measuring a pitch difference between the sound and the reference tone, and a display, which is arranged in the backside of the housing so as to display the pitch difference measured by the measurement unit. The electronic musical instrument of the present invention allows the user to easily set up frequencies of the reference tones by simply depressing the corresponding keys of the keyboard in relation to a plurality of musical tones, which are generated by at least one musical instrument subjected to tuning, whereby the player of the musical instrument is notified of the pitch differences between the reference tones and the musical tones subjected to tuning in an effective manner by way of the display.

Preferably, the display is detachably attached to the backside of the housing in a freely rotatable manner. This allows the user to appropriately adjust the direction of the display to suit the position of the musical instrument. In addition, the measurement unit can measure a plurality of pitch differences between the reference tones and the musical tones, which are generated by plural musical instruments and are received by the microphone, whereby the pitch differences are displayed in comparison with each other by way of the display. Herein, the players of the plural musical instruments can listen to the reference tones and harmony in advance before they actually play the musical instruments to produce the musical tones subjected to tuning. In addition, the display allows the players to visually recognize the pitch differences and the harmony which is established between one's musical instrument and the other's musical instrument.

The aforementioned electronic musical instrument further includes a plurality of tone color switches for designating a plurality of tone colors with respect to a plurality of musical tones subjected to tuning, wherein the musical tones are received by the microphone and are extracted by the measurement unit in correspondence with the tone colors, so that the measurement unit measures a plurality of pitch differences between the reference tones and the musical tones, whereby the pitch differences are displayed in comparison with each other by way of the display. Herein, even when plural musical tones are mixed and simultaneously received by the microphone, it is possible to accurately measure the pitch differences with respect to the pitch differences in accordance with the tone colors, which serve as key factors for extracting frequencies of the musical tones from the output signal of the microphone.

In the above, the tone generator generates the reference tones having the designated tone colors with respect to the musical tones, which are received by the microphone and are extracted by the measurement unit in correspondence with the tone colors, so that the measurement unit measures a plurality of pitch differences between the reference tones and the musical tones, whereby the pitch differences are displayed in comparison with each other by way of the display. Herein, when constituent sounds of a chord are subjected to tuning, the tone generator generates the reference tones having the same tone color as the constituent sounds in advance, so that the pitch differences are correspondingly measured between the reference tones and the constituent sounds actually produced by a musical instrument.

Furthermore, the tone generator sequentially generates the reference tones having the tone colors, which are sequentially selected, with respect to the musical tones subjected to tuning, which are received by the microphone and are extracted by the measurement unit in correspondence with the tone colors, so that the measurement unit measures a plurality of pitch differences between the reference tones and the musical tones, whereby the pitch differences are displayed in comparison with each other by way of the display.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

The present invention will be described in further detail by way of examples with reference to the accompanying drawings.

Figure 1A:
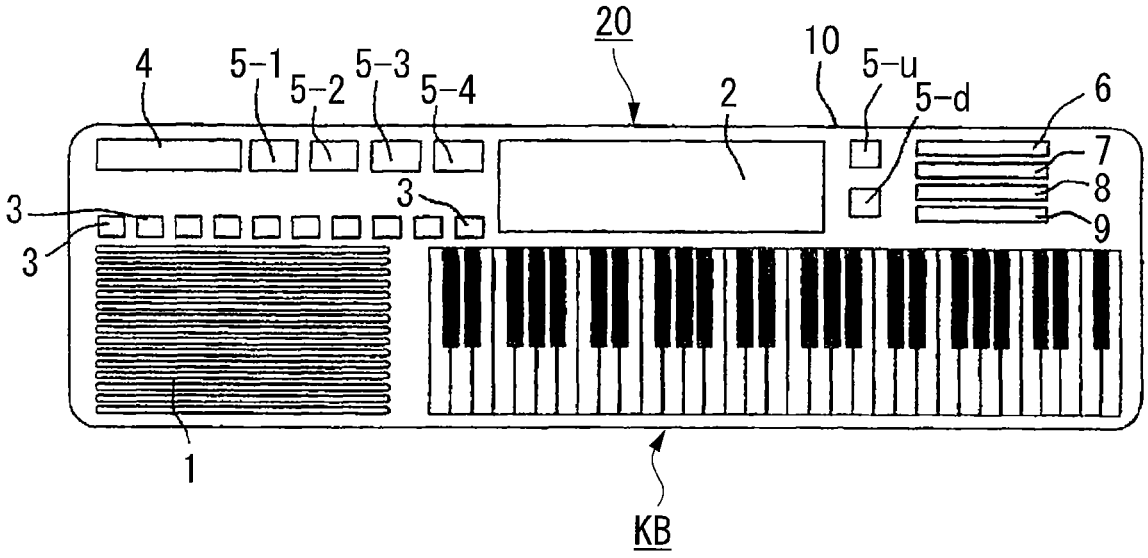
FIG. 1A is a plan view showing the exterior appearance of an electronic musical instrument having a tuning device in accordance with a preferred embodiment of the present invention.
Figure 1B:
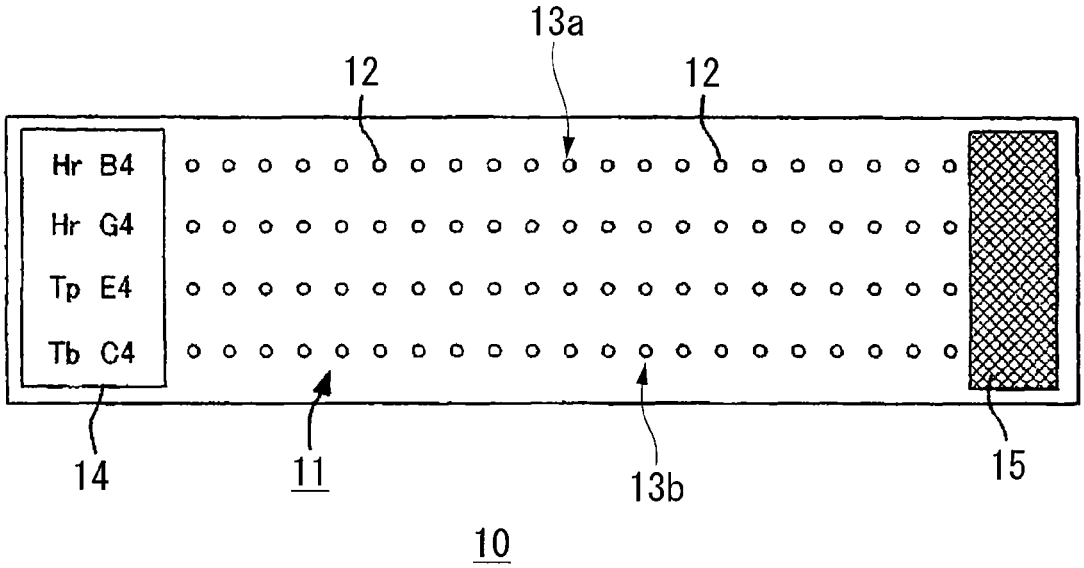
FIG. 1B is a rear view showing a backside of a housing of the electronic musical instrument.

FIG. 1A is a plan view showing the exterior appearance of an electronic musical instrument having a tuning device in accordance with a preferred embodiment of the present invention; and FIG. 1B is a rear view showing a backside 10 of a housing 20 of the electronic musical instrument. The electronic musical instrument of FIG. 1A includes a keyboard KB, which is similar to normal keyboards installed in conventionally-known electronic musical instruments. A speaker 1 is arranged on the left side of the keyboard KB; and a liquid crystal display (LCD) 2 for displaying various types of information is arranged on the upper side of the keyboard KB.

On the left side of the LCD 2, there are provided a plurality of tone color switches 3 for designating various kinds of tone colors such as a flute and a trumpet, a mode switch 4 for changing over operation modes of the electronic musical instrument, and four reference tone switches 5-k (where k=1 to 4) for designating reference tones. The operation of the reference tone switches 5-k will be described later.

On the right side of the LCD 2, there are provided cursor switches 5-u and 5-d, which are used for increment and decrement of various values, a reference pitch switch 6, which is operated to adjust a frequency of a note A (whose default value in frequency is 440 Hz) so as to designate a reference pitch, a temperament switch 7 for designating a temperament, a scale switch 8 for designating scales such as C, D#, D, D#, . . . , B and AUTO, and a reference tone shift switch 9 for designating a reference tone from among ROOT, A, and Bb in view of the equal temperament, based on which the frequency of each key is to be shifted as necessary.

The electronic musical instrument of the present embodiment has two operation modes, i.e., a play mode and a tuning mode. In the play mode, the present embodiment operates similar to the conventionally-known electronic keyboard instrument, so that musical tones are designated upon playing of the keyboard KB and are produced by means of the speaker 1. In the tuning mode, a reference tone having a desired pitch is produced by the speaker 1; a musical tone actually produced by a musical instrument subjected to tuning is recorded; then, a pitch difference between the reference tone and the actually produced musical tone is detected. The keyboard KB is used to designate a keycode of a reference tone in the tuning mode.

A method for the determination of frequencies of musical tones, which are produced upon playing of the keyboard KB (i.e., key-depressing operations), will be described below with respect to two conditions, as follows:

(a) First condition in which the user designates any one of scales (e.g., C, C#, D, D#, . . . , B) except for AUTO by means of the scale switch 8.

The frequency of a musical tone is calculated based on a reference pitch designated by means of the reference pitch switch 6, a temperament designated by means of the temperament switch 7, a scale designated by means of the scale switch 8, a reference tone designated by means of the reference tone shift switch 9, and a keycode of a key actually depressed by the user.

(b) Second condition in which the user designates AUTO by means of the scale switch 8.

The frequency of a musical tone is calculated based on a reference pitch designated by means of the reference pitch switch 6, a temperament designated by means of the temperament switch 7, a scale, which is automatically determined based on keycodes of three or more keys simultaneously depressed in advance, and a keycode of a key actually depressed. Herein, the scale, which is automatically determined in advance, is applied to calculations of the frequency of a musical tone unless three or more keys are simultaneously depressed.

The frequency of a musical tone, which is determined as described above so as to form the frequency of a musical tone actually produced by the speaker 1, serves as a root frequency used for calculations of a pitch difference with respect to a musical tone actually produced by a musical instrument subjected to tuning.

The tuning realized by the electronic musical instrument has various technical features, which will be described below.

(1) First Feature

A chord consisting of plural references tones having different pitches is produced by the speaker 1; a maximum of four musical tones produced by plural musical instruments subjected to tuning are simultaneously recorded; thus, pitch differences are calculated with respect to plural musical tones in comparison with reference tones. In the tuning mode, four reference tones forming a chord are denoted as a first reference tone, a second reference tone, a third reference tone, and a fourth reference tone, which are designated by sequentially depressing keys. Herein, a fifth reference tone and its following reference tones are not subjected to tuning.

(2) Second Feature

Upon the operation of the reference tone switch 5-k (where k=1 to 4), it is possible to designate a reference tone and a tone color with respect to a musical tone of a musical instrument subjected to tuning. In the present embodiment, the reference tone switch 5-k is turned on so as to designate a reference tone k (i.e., any one of first to fourth reference tones); then, the tone color switch 3 is turned on in correspondence with a desired musical instrument so as to designate a tone color, which is used for the reference tone k. Herein, the tone color of the reference tone k is determined as the tone color of a musical tone produced by a musical instrument subjected to tuning. In accordance with the determination, the electronic musical instrument performs processing for calculating a pitch difference with respect to a musical tone of a musical instrument subjected to tuning. That is, the reference tone switch 5-k and the tone color switch 3 form a means for designating the tone color of a reference tone and a means for designating the tone color of a musical tone, which is produced by a musical instrument subjected to tuning based on the reference tone.

(3) Third Feature

The third feature is a display of tuning results. As shown in FIG. 1B, a relatively large display 11 for displaying tuning results is arranged and substantially occupies the overall area of the backside 10 of the housing 20 of the electronic musical instrument. Specifically, the display 11 includes four lines of light-emitting diodes (LED) 12, which are horizontally aligned, wherein each line will be called an LED line. The four LED lines are counted from the bottom of the backside 10 of the housing 20 shown in FIG. 1B, wherein a first LED line (i.e., the lowermost line of LEDs 12) indicates a pitch difference with respect to a musical tone, which is produced by a musical instrument subjected to tuning in response to a first reference tone; a second LED line indicates a pitch difference with respect to a musical tone produced in response to a second reference tone; a third LED line indicates a pitch difference produced in response to a musical tone produced in response to a third reference tone; and a fourth LED line (i.e., the uppermost line of LEDs 12) indicates a pitch difference produced in response to a fourth reference tone.

In each of the four LED lines, the LEDs 12 are aligned with equal spacing therebetween, wherein the LEDs 12 aligned in one LED line horizontally match in position with the LEDs 12 aligned in the other LED line. A marker 13*a* is positioned at the center above the uppermost LED line, and a marker 13*b* is positioned at the center below the lowermost LED line, whereby four LEDs 12, which are positioned at the centers of the four LED lines, are aligned vertically between the markers 13*a* and 13*b*. Herein, each of the center LEDs 12 vertically aligned between the markers 13*a* and 13*b* turns on when a pitch difference between a reference tone and a musical tone (which is produced by a musical instrument subjected to tuning) is zero cent. When the musical tone is higher than the reference tone in pitch by five cents, an LED 12 positioned on the right and adjacent to the center LED 12 is turned on. When the musical tone is higher than the reference tone in pitch by ten cents, the next LED 12 (which is positioned on the right and next to the aforementioned LED 12) is turned on. That is, the LEDs 12 are sequentially turned on in a rightward direction when the pitch difference increases in units of five cents. In contrast, when the musical tone is lower than the reference tone in pitch by five cents, an LED 12 positioned on the left and adjacent to the center LED 12 (indicated by the markers 13*a* and 13*b*) is turned on. When the musical tone is lower than the reference tone in pitch by ten cents, the next LED 12 (which is positioned on the left and next to the aforementioned LED 12) is turned on. That is, the LEDs 12 are sequentially turned on in a leftward direction when the pitch difference decreases in units of five cents. As described above, the four LED lines indicate pitch differences with respect to musical tones, which are respectively produced in response to first to fourth reference tones by means of a musical instrument subjected to tuning, by way of the LEDs 12, which are horizontally aligned and are sequentially turned on in the left or right of the center position indicated by the markers 13*a* and 13*b*.

In order to improve visual recognition, it is possible to form the markers 13*a* and 13*b* by means of light-emitting diodes, for example. In this case, the colors of the LEDs 12 can be changed in such a way that the horizontally aligned LEDs 12 are all colored in green, while the light-emitting diodes forming the markers 13*a* and 13*b* are colored in red. Alternatively, the center LEDs 12 (which are turned on when pitch differences are zero cents) can be changed in color in comparison with the other LEDs 12. This improves the visual recognition for the user with respect to the center LEDs 12, which are turned on when pitch differences are zero cents.

A liquid crystal display (LCD) 14 is arranged on the left of the display 11. The LCE 14 displays four sets of tone colors and keycodes with respect to first to fourth reference tones (which are indicated by four pairs of characters displayed from the bottom to the top), wherein the tone colors are designated as tone colors of musical tones produced by a musical instrument subjected to tuning in response to first to fourth reference tones. Specifically, lowermost characters Tb and C4 indicate the tone color of a first reference tone (i.e., a trombone) and its keycode; characters Tp and E4 indicate the tone color of a second reference tone (i.e., a trumpet) and its keycode; characters Hr and G4 indicate the tone color of a third reference tone (i.e., a first horn) and its keycode; and uppermost characters Hr and B4 indicate the tone color of a fourth reference tone (i.e., a second horn) and its keycode. A microphone 15 is arranged on the left of the display 11 so as to input musical tones produced by a musical instrument subjected to tuning.

Figure 2:
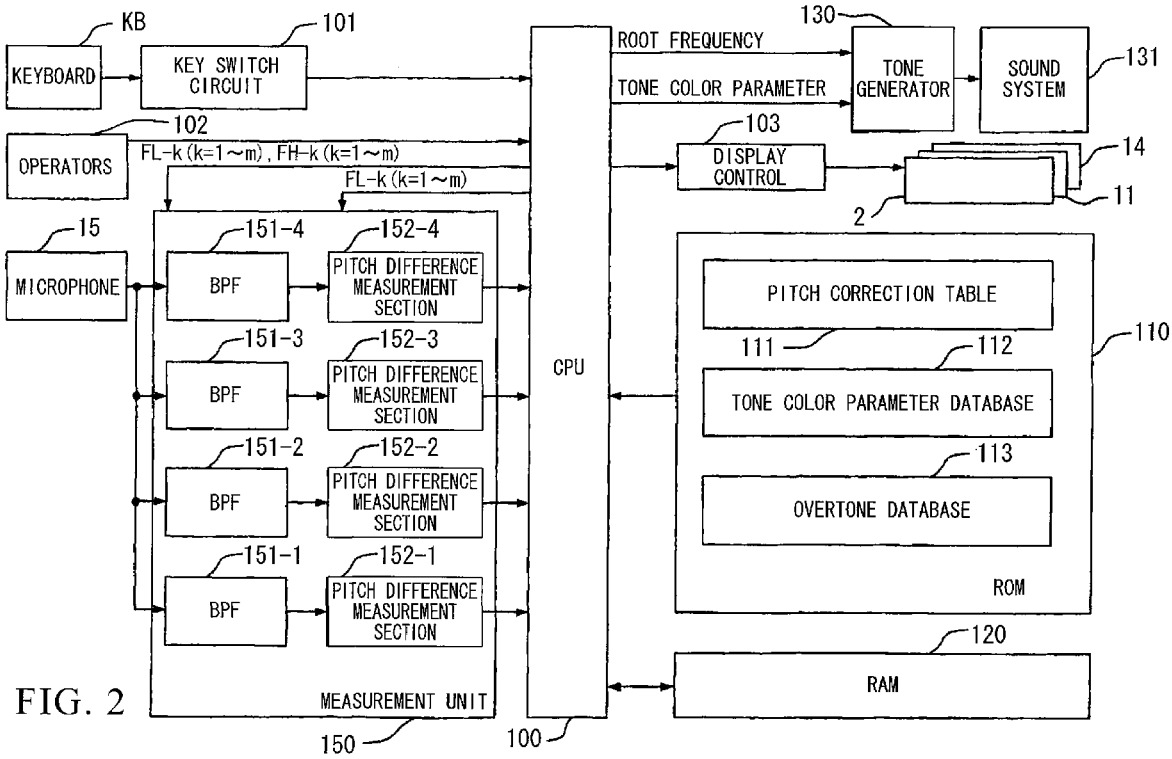
FIG. 2 is a block diagram showing the electronic configuration of the electronic musical instrument.

FIG. 2 is a block diagram showing the electronic configuration of the electronic musical instrument, wherein a CPU 100 controls various parts and components of the electronic musical instrument. A key switch circuit 101 includes a plurality of key switches, which are arranged in correspondence with a plurality of keys of the keyboard KB. The CPU 10 detects key-on events and key-off events, which are produced by the keyboard KB, by means of the key switch circuit 101. Operators 102 are manually operable members such as the tone color switches 3 (see FIG. 1A), which are arranged in the housing 20 of the electronic musical instrument. A display control 103 controls various display elements such as the LCD 2 (see FIG. 1A) and the display 11 and the LCD 14 (see FIG. 1B), which are arranged in the housing 20 of the electronic musical instrument, in accordance with instructions given from the CPU 100.

A ROM 110 is a read-only memory for storing various programs, which are used to control various parts and components of the electronic musical instrument, and various types of information, which are used to control the electronic musical instrument. A RAM 120 is used as a work area under the control of the CPU 100. A tone generator (or a sound source) 130 forms musical tone signals having designated tone colors and pitches under the control of the CPU 100. The tone generator 130 has a plurality of musical tone forming channels used for forming musical tone signals, whereby it is possible to simultaneously generate plural musical tone signals. A sound system 131 produces musical tones based on musical tone signals formed by the tone generator 130 by means of the speaker 1 shown in FIG. 1A.

The ROM 110 includes three sections for storing various types of information, i.e., a pitch correction table 111, a tone color parameter database 112, and an overtone database 113. Specifically, the pitch correction table 111 stores correction values, by which root frequencies (i.e., frequencies of roots (or first-mode overtones) corresponding to pitches of musical tones), which are designated in correspondence with keycodes with reference to the equal temperament, are corrected to match prescribed root frequencies, which are determined in response to combinations of temperaments and scales. The CPU 100 refers to the pitch correction table 111 in order to calculate root frequencies of musical tone signals, which are formed in response to key-on events. Specifically, upon the detection of a key-on event in response to depression of a key having a certain keycode, the CPU 100 calculates the root frequency in correspondence with the keycode of the depressed key in view of the equal temperament on the basis of the reference pitch, which is presently set up. When any one of the aforementioned scales C, C#, D, D#, . . . , and B is designated by the scale switch 8, the CPU 100 detects the designated scale. When AUTO is designated by the scale switch 8, the CPU 100 determines a prescribed scale based on the combination of keycodes designated by plural key-on events. When the temperament presently set up is not the equal temperament, the CPU 100 refers to a correction value corresponding to a reference tone designated by the reference tone shift switch 9 and another reference tone corresponding to the keycode of the depressed key within correction values, which are stored in the pitch correction table 111 in response to the combination of the temperament and scale, whereby the CPU 100 corrects the correction value corresponding to the keycode of the depressed key in such a way that the correction value corresponding to the reference tone designated by the reference tone shift switch 9 becomes zero cent. By use of the corrected correction value, the root frequency calculated in view of the equal temperament is shifted so as to produce the root frequency for a musical tone signal to be generated.

The tone color parameter database 112 stores tone color parameters, which the tone generator 130 needs in order to form musical tone signals having tone colors, which can be designated by means of the tone color switches 3. The overtone database 113 stores overtone data designating overtones having tone colors, which can be designated by the tone color switches 3 in accordance with a musical spectrum. Each musical instrument may differ in overtones in response to registers. Hence, the overtone database 113 stores overtone data designating overtones with regard to musical tones, which are designated in relation to registers of the aforementioned musical instrument. The CPU 100 refers to the overtone database 113 in order to determine measurement conditions for pitch differences, which are detected between reference tones and musical tones of a musical instrument subjected to tuning.

In the present embodiment, the speaker 1 produces a chord consisting of a maximum of four reference tones having different pitches, and the microphone 15 simultaneously receives musical tones of plural musical instruments subjected to tuning, thus calculating pitch differences between reference tones and musical tones subjected to tuning. A measurement unit 150 is arranged to accomplish the aforementioned functions. The measurement unit 150 includes four band-pass filters (BPFs) 151-k (where k=1 to 4) whose transmission bands can be controlled and which are followed by four pitch difference measurement sections 152-k (where k=1 to 4) respectively.

Suppose that the microphone 15 receives m musical tones subjected to tuning (where mis an integer greater than "1") in relation to m reference tones. In this case, the CPU 100 measures pitch differences between m musical tones subjected to tuning and m reference tones by means of the BPF 151-k (where k=1 to m) and the pitch difference measurement section 152-k (where k=1 to m), thus displaying the pitch differences by means of the display 11 under the control of the display control 103.

Specifically, the CPU 100 calculates root frequencies Ff-k and extracted frequencies Ft-k with respect to m reference tones respectively. Herein, the root frequency Ff-k is calculated with reference to a keycode of a key, which is depressed to generate a reference tone k, a combination of temperament and scale, the pitch correction table 111, the state of the reference tone shift switch 9, and a reference pitch. Then, the CPU 100 sets the calculated m reference frequencies Ff-k (where k=1 to m) to the pitch difference measurement sections 152-k (where k=1 to m) respectively.

The extracted frequency Ft-k is a center frequency of the transmission band of the BPF 151-k and is selected from among the root frequency of the reference tone k and the frequencies of its overtones. That is, the extracted frequency Ft-k (where k=1 to m), which is selected with regard to each of m reference tones, may match the root frequency Ff-k of the reference tone or one of frequencies of second-mode and third-mode overtones (derived from the reference tone).

In order to select the extracted frequencies Ft-k (where k=1 to m) with respect to m reference tones, the CPU 100 refers to overtone data stored in the overtone database 113 in correspondence with tone colors of reference tones (corresponding to musical tones subjected to tuning), wherein spectra of reference tones are disposed along the common frequency axis so that the spectra of specific reference tones, which can be easily distinct from the spectra of other reference tones, are selected in relation to m reference tones, whereby frequencies of the selected spectra are set to the extracted frequencies Ft-k (where k=1 to m). Then, transmission bands whose center frequencies match the extracted frequencies Ft-k (where k=1 to m) are determined, so that lower-limit frequencies FL-k (where k=1 to m) and upper-limit frequencies FH-k (where k=1 to m) of the transmission bands are set to the BPFs 151-k (where k=1 to m) respectively. Herein, the transmission band of the BPF 151-k allows only the spectrum whose frequency lies in nearest proximity to the extracted frequency Ft-k to be transmitted therethrough but blocks other spectra to be transmitted therethrough.

The processing of the pitch difference measurement sections 152-k (where k=1 to m) depends upon the condition of whether the extracted frequency Ft-k matches the root frequency Ff-k or its overtone frequency. When the extracted frequency Ft-k matches the root frequency Ff-k, the pitch difference measurement section 152-k measures the frequency of an output signal of the BPF 151-k so as to calculate a pitch difference (expressed by the number of cents existing between the compared frequencies) between the measured frequency and the root frequency Ff-k. When the extracted frequency Ft-k does not match the root frequency Ff-k but matches its overtone frequency, the pitch difference measurement section 152-k measures the frequency of an output signal of the BPF 151-k (i.e., the overtone frequency), based on which the root frequency of a musical tone subjected to tuning is produced with respect to the reference tone k. Then, it calculates a pitch difference with respect to the root frequency Ff-k of a musical tone subjected to tuning.

The present embodiment is characterized in a measurement method of pitch differences, which will be described below.

The conventionally-known tuning devices have functions for measuring root frequencies of musical tones subjected to tuning, based on which pitch differences are calculated with respect to root frequencies of reference tones.

The conventionally-known measurement method described above is effective in handling a single musical tone subjected to tuning; however, it is very difficult to measure root frequencies of plural musical tones subjected to tuning, which are mixed and simultaneously collected, because of the following reasons.

In musical instruments, root spectra do not always have maximum intensities. Even in the same musical instrument, the intensities of overtones depend upon registers; hence, each musical instrument has a specific overtone configuration. In the case of a flute, for example, roots are maximum components among musical tones thereof unless low-pitch musical tones are produced intensely. On average, the intensity of the overtone becomes small as the overtone frequency becomes high. In the case of an oboe and a bassoon (or a fagot), intense overtones are concentrated at prescribed frequency bands due to formants. A clarinet does not produce even-ordered resonances due to a closed cylindrical tube thereof, in which one end is opened but the other end is closed in terms of acoustics. The spectrum envelope of a trumpet sound is expressed in the form of a waveform having gradual slopes and a peak of approximately 2 kHz or so, wherein overtones are increased in intensity compared with roots. This is taught in the foregoing book entitled "Acoustics of Musical Instruments".

When the microphone 15 receives plural musical tones subjected to tuning, which are mixed together, it is very difficult to detect spectra of roots corresponding to musical tones subjected to tuning from among spectra of output signals of the microphone 15. This makes it difficult to calculate pitch differences with respect to plural musical tones subjected to tuning.

However, when a musical instrument producing plural musical tones subjected to tuning is specified in advance, overtone spectra, which can be easily extracted from among spectra of output signals of the microphone 15, are selected with respect to musical tones subjected to tuning by means of the BPF-k (where k=1 to 4) and are used for calculations of pitch differences.

The measurement of pitch differences adapted to the present embodiment is designed based on the aforementioned concept.

Figure 3:
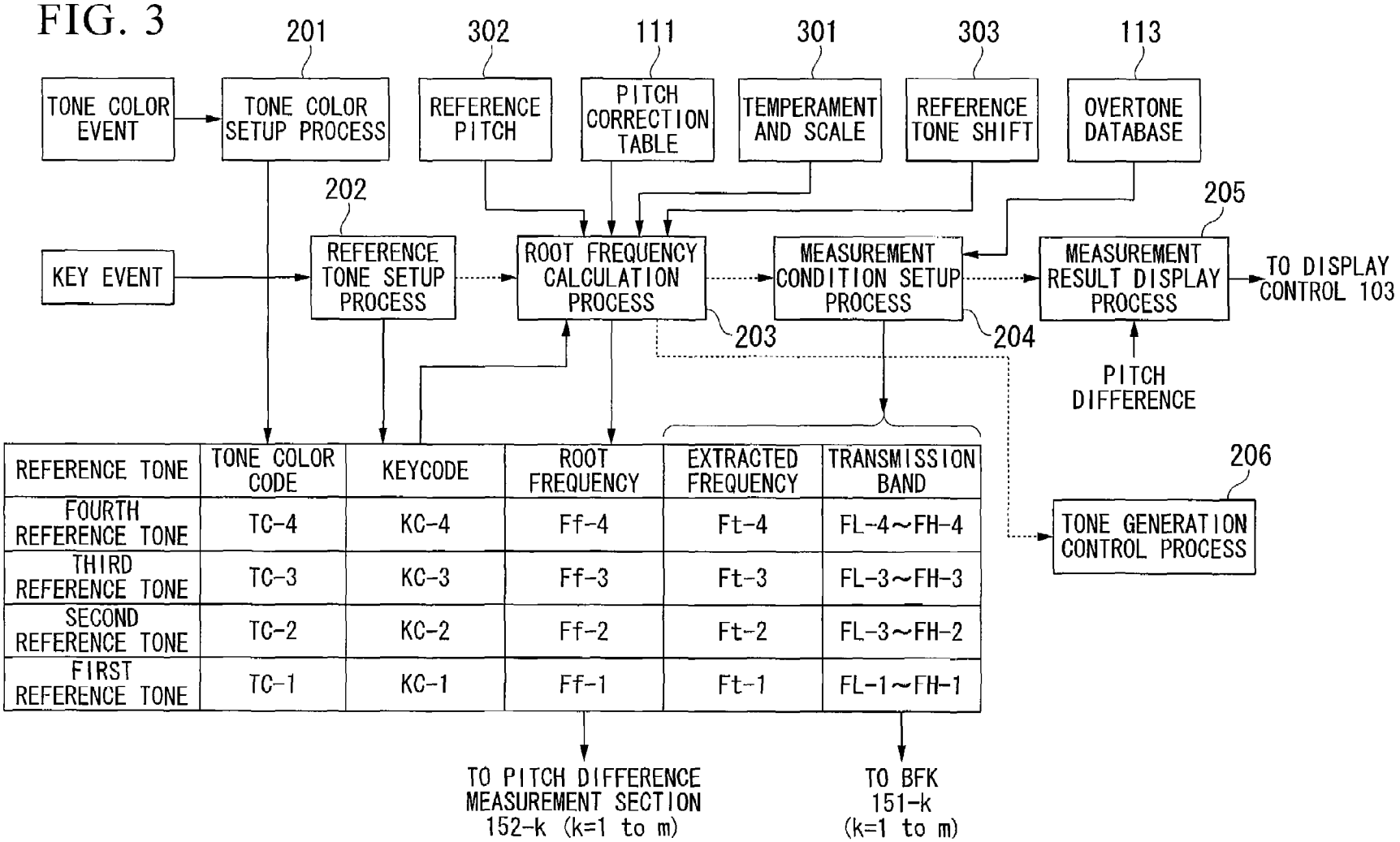
FIG. 3 is a block diagram showing processes executed by a CPU in a tuning mode of the electronic musical instrument.

Next, the overall operation of the electronic musical instrument will be described in detail, in particular with regard to the tuning mode (which forms the outstanding technical feature of the present embodiment). FIG. 3 shows the contents of processes executed by the CPU 100 in the tuning mode. That is, the CPU 100 performs a tone color setup process 201, a reference tone setup process 202, a root frequency calculation process 203, a measurement condition setup process 204, a measurement result display process 205, and a tone-generation control process 206.

In the tone color setup process 201, the CPU 100 monitors the operations of the tone color switches 3 and the reference tone switches 5-k (where k=1 to 4). In order to perform tuning by use of a chord, the user sets up tone colors with respect to reference tones forming the chord. That is, the user turns on the reference tone switch 5-k so as to designate the reference tone k; subsequently, the user turns on the tone color switch 3 for designating the tone color of a desired musical instrument. In the tone color setup process 201, a tone color code assigned to the tone color switch 3 presently turned on is set to a tone color code TC-k with regard to the reference tone k. Then, the user operates the temperament switch 8 so as to set up a desired temperament.

Next, when the user depresses keys of the keyboard KB, the CPU 100 proceeds to the reference tone setup process 202 so as to produce keycodes KC-k (where k=1 to m) with respect to m reference tones, which the user designates on the keyboard KB.

Figure 4:
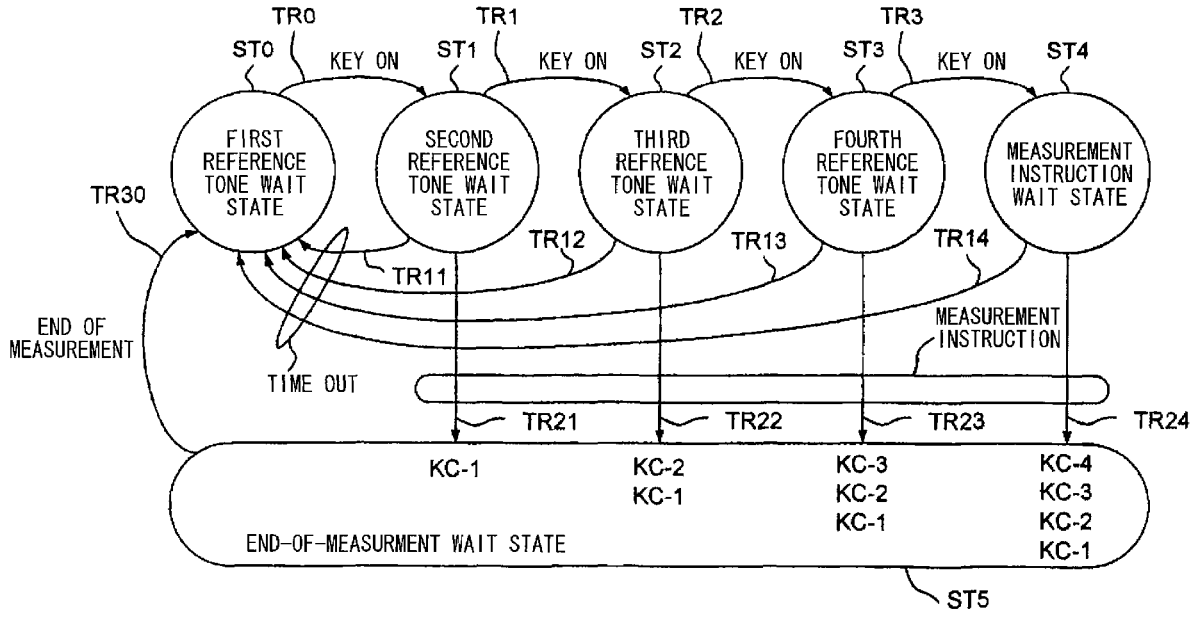
FIG. 4 is a state transition diagram showing the overall operation of a reference tone setup process shown in FIG. 3.

FIG. 4 is a state transition diagram showing detailed operations of the reference tone setup process 202. Herein, the reference tone setup process 202 includes six states, i.e., a first reference tone wait state ST0, a second reference tone wait state ST1, a third reference tone wait state ST2, a fourth reference tone wait state ST3, a measurement instruction wait state ST4, and an end-of-measurement wait state ST5.

In the initial state, the reference tone setup process 202 is set to the first reference tone wait state ST0. Upon detection of a key-on event on the keyboard KB, the reference tone setup process 202 sets the keycode of a depressed key to a first reference tone keycode KC−1, so that a transition TR0 occurs from the first reference tone wait state ST0 to the second reference tone wait state ST1. In the second reference tone wait state ST1, when a new key-on event is detected so that the keycode of a newly depressed key differs from the first reference tone keycode KC−1, the keycode of the newly depressed key is set to a second reference tone keycode KC−2; thus, a transition TR1 occurs from the second reference tone wait state ST1 to the third reference tone wait state ST2.

Similarly, a transition occurs from one state to another state every time a new key-on event whose keycode differs from the previously reference tone keycode occurs. That is, a transition TR2 occurs from the third reference tone wait state ST2 to the fourth reference tone wait state ST3; and a transition TR3 occurs from the fourth reference tone wait state ST3 to the measurement instruction wait state ST4. In the third reference tone wait state ST2, the keycode of a newly depressed key is set to a third reference tone keycode KC−3. In the fourth reference tone wait state ST3, the keycode of a newly depressed key is set to a fourth reference tone keycode KC−4.

Every time the keycode of each reference tone is determined during the execution of the reference tone setup process 202, the keycode is transferred to the root frequency calculation process 203. Upon reception of the keycode KC-k of the reference tone k, the root frequency calculation process 203 (see FIG. 3) calculates the root frequency Ff-k based on the keycode KC-k, a temperament and scale 301, a reference tone shift 303, the pitch correction table 111, and a reference pitch 302. Then, the root frequency Ff-k of the reference tone k is transferred to the tone generation control process 206 together with the tone color code TC-k of the reference tone k. In the tone generation control process 206, a tone color parameter is read from the tone color parameter database 112 in correspondence with the tone color code TC-k; then, the tone color parameter is supplied to the tone generator 130 together with the information for designating the root frequency Ff-k, whereby a musical tone signal of the reference tone k is formed so that the corresponding musical tone is produced. A series of the aforementioned operations are performed every time the keycode of each reference tone is determined, whereby plural reference tones having the designated tone colors and pitches are sequentially produced upon depression of keys.

When no measurement instruction is given and no other key-on event is detected in each of the second reference tone wait state ST1, the third reference tone wait state ST2, and the fourth reference tone wait state ST3, the reference tone setup process 202 returns to the first reference tone wait state ST0 upon a lapse of a prescribed time. This is realized by transitions TR11, TR12, TR13, and TR14. In this case, the keycode of each reference tone previously set up is invalidated.

A measurement instruction is given upon detection of a key-on event, which is identical to the first reference tone keycode KC−1 and is detected in the second reference tone wait state ST1. In this case, the measurement condition setup process 204 is activated, and the reference tone setup process 202 proceeds to the end-of-measurement wait state ST5 via a transition TR21.

In the above, the third reference tone wait state ST2, the fourth reference tone wait state ST3, and the measurement instruction wait state ST4 are subjected to an all-key-off state in which no key is depressed on the keyboard KB. Then, when plural key-on events including a key-on event whose keycode is identical to the keycode of a prescribed reference tone are simultaneously detected, the simultaneous occurrence of plural key-on events is reported to the root frequency calculation process 203. The root frequency calculation process 203 transfers the root frequencies Ff-k (where k=1 to m) and the tone color codes TC-k (where k=1 to m), which are determined in advance with respect to m reference tones (where 2≦m≦4), to the tone generation control process 206. The tone generation control process 206 extracts tone color parameters corresponding to the tone color codes TC-k with respect to m reference tones, whereby it controls the tone generator 130 to form musical tone signals with respect to m reference tones, so that the corresponding musical tones are produced. Thus, the speaker 1 produces a chord consisting of m reference tones. Thereafter, when the all-key-off state occurs again, the reference tone setup process 202 activates the measurement condition setup process 204, wherein transitions TR22, TR23, and TR24 occur from the aforementioned states ST2, ST3, and ST4 to the end-of-measurement wait state ST5.

The measurement condition setup process 204 sets up the transmission bands of the BFKs 151-k (where k=1 to m) and the pitch difference measurement sections 152-k (where k=1 to m) in response to the number "m" of reference tones, whereby pitch differences are measured with respect to m musical tones subjected to tuning. At completion of the measurement of pitch differences, a transition TR30 occurs from the end-of-measurement wait state ST5 to the first reference tone wait state ST0 in the reference tone setup process 202 shown in FIG. 4.

Figure 5A:
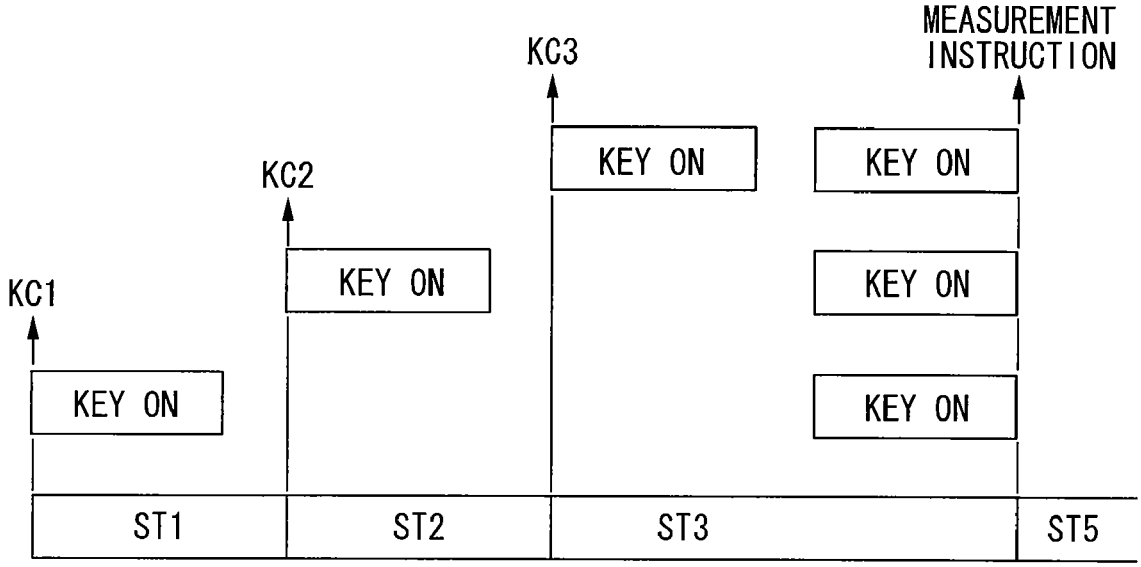
FIG. 5A is a time chart in which three keys are sequentially depressed by releasing fingers.
Figure 5B:
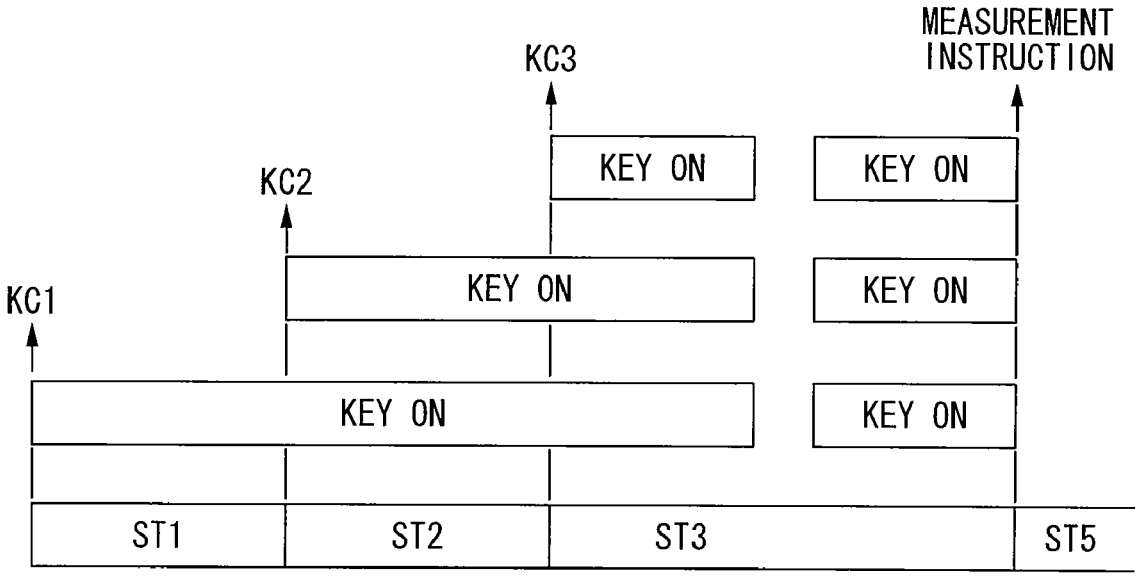
FIG. 5B is a time chart in which three keys are sequentially depressed without releasing fingers.

FIGS. 5A and 5B show details of operations in which keycodes of reference tones are set up so as to start measuring pitch differences, wherein FIG. 5A shows an example in which the user sequentially depresses keys but releases the finger after depression of each key, and FIG. 5B shows an example in which the user sequentially depresses keys with different fingers without releasing the fingers. In both of the aforementioned examples, the same state transition is adapted to the reference tone setup process 202. In the examples of FIGS. 5A and 5B, the user sequentially depresses different keys so as to realize the state transition in the reference tone setup process 202 in an order of ST1, ST2, and ST3, thus detecting the first reference tone keycode KC−1, the second reference tone keycode KC−2, and the third reference tone keycode KC−3. An all-key-off state is detected in the fourth reference tone wait state ST3, so that three key-on events occur; then, a measurement instruction occurs upon detection of an all-key-off state again. At the timing at which the measurement instruction occurs, in other words, at the timing at which the electronic musical instrument stops generating a chord consisting of the keycodes KC−1, KC−2, and KC−3, players of musical instruments simultaneously generate musical tones subjected to tuning. The musical tones subjected to tuning are supplied to the measurement unit 150 by way of the microphone 15 and are subjected to measurement of pitch differences.

The measurement condition setup process 204 operates differently in response to a first case in which a single reference tone is generated (i.e., m=1) and a second case in which plural reference tones are generated. In the first case (i.e., m=1), the measurement condition setup process 204 extracts the root frequency Ff−1 in view of the first reference tone keycode KC−1 and sets it to the pitch difference measurement section 152-1. In addition, the measurement condition setup process 204 sets the root frequency Ff−1 to the extracted frequency Ft−1, which is used as a center frequency so as to determine a transmission band of the BPF 151-1 ranging from FL−1 to FH−1.

In the second case (in which m reference tones are generated), the measurement condition setup process 204 operates as follows:

First, the measurement condition setup process 204 extracts the root frequencies Ff-k (where k=1 to m) in view of the m keycodes KC-k (where k=1 to m) and sets them to the pitch difference measurement sections 152-k (where k=1 to m). Next, the measurement condition setup process 204 reads overtone data from the overtone database 113 in correspondence with the tone color codes TC-k (where k=1 to m), which are extracted with respect to m reference tones. With reference to the read overtone data, specific spectra of m reference tones, which can be easily distinguished from spectra of other reference tones, are selected and are set to the extracted frequencies Ft-k (where k=1 to m). The extracted frequencies Ft-k are used as center frequencies so as to determine transmission bands of the BPFs 151-k (where k=1 to m).

As a method for selecting extracted frequencies Ft-k (where k=1 to m), frequency differences between spectra of reference tones and spectra of other reference tones are subjected to addition with appropriate weights applied thereto, or intensities of spectra of other reference tones are subjected to addition with appropriate weights applied thereto, thus calculating the costs representing the ease of distinction with spectra of other reference tones, whereby the spectrum frequency having the highest cost is selected. Preferably, in order to select further an appropriate extracted frequency to be selected, the following criteria are introduced so as to narrow down the selection range of extracted frequencies.

(a) When a flute is included in plural reference tones (or plural musical tones subjected to tuning), the flute is given a first priority, so that the root frequency is selected as the extracted frequency with respect to the reference tone of the flute.

(b) When an oboe and a bassoon are included in plural reference tones (or plural musical tones subjected to tuning), overtone frequencies belonging to bands at which specific intense overtones are concentrated are selected as extracted frequencies with respect to reference tones of oboe and bassoon.

(c) When a clarinet is included in plural reference tones (or plural musical tones subjected to tuning), extracted frequencies are selected from bands corresponding to even-ordered overtones, which the clarinet does not produce, with respect to reference tones other than the reference tone of the clarinet.

(d) When a trumpet is included in plural reference tones (or plural musical tones subjected to tuning), overtone frequencies of the trumpet, which are the most intense and in proximity to 2 kHz, are selected as extracted frequencies.

After completion of the setup of the transmission bands of the BPF 151-k (where k=1 to m) and the setup of the root frequencies of the pitch difference measurement sections 152-k (where k=1 to m), the measurement condition setup process 204 sends a measurement instruction to the measurement unit 150 when all of the keys simultaneously depressed are subjected to the all-key-off state. Upon reception of the measurement instruction, the measurement unit 150 performs processing for calculating pitch differences with respect to m musical tones subjected to tuning within output signals of the microphone 150 by means of the BPFs 151-k (where k=1 to m) and the pitch difference measurement sections 152-k (where k=1 to m). Then, the calculated pitch differences, which are calculated with respect to m musical tones subjected to tuning, are transferred to the measurement result display process 205. The measurement result display process 205 transfers the tone colors codes TC-k (where k=1 to m), the keycodes KC-k (where k=1 to m), and the pitch differences, which are produced with respect to m musical tones subjected to tuning, to the display control 103. Under the control of the display control 103, the tone colors (i.e., the names of musical instruments) of the musical tones subjected to tuning and the tone names are displayed on the LCD 14, and the pitch differences are displayed by way of the display 11. When the number "m" of the musical tones subjected to tuning is less than "4", the display control 103 controls the LCD 14 to display prescribed symbols such as "–" instead of the tone color and tone name of the musical tone subjected to tuning.

The player of each musical instrument subjected to tuning visually recognizes the names of musical instruments displayed on the LCD 14, which is positioned in the left of the display 11 (see FIG. 1B) so as to determine the player's musical instrument or to visually recognize the name of a musical tone to be generated. Thus, the player of each musical instrument can visually see how much the musical tone subjected to tuning is shifted in pitch in either the pitch ascending direction or pitch descending direction in comparison with the corresponding reference tone. When all the musical tones subjected to tuning are each shifted in pitch by five cents lower than the pitches of the corresponding reference tones, all LEDs 12, which are turned on in the LED lines, are vertically disposed in line. This indicates that a good harmony is produced.

As described above, the electronic musical instrument of the present embodiment is designed such that pitch differences, which are calculated with respect to musical tones subjected to tuning, are displayed by way of the display 11, which occupies a relatively large area of the backside 10 of the housing 20; hence, the players of musical instruments subjected to tuning can speedily and easily recognize the pitch differences of their own musical instruments. The present embodiment is characterized in that pitch differences are displayed by way of the display 11 through comparison between musical tones subjected to tuning (i.e., constituent tones of a chord) and reference tones; hence, players of musical instruments who play the constituent tones of a chord respectively can easily recognize whether or not a good harmony is established between constituent tones and the relationship between the pitch of one's constituent tone and the pitches of the other's constituent tones. In addition, the present embodiment can set up the tone color of a reference tone, which is produced upon depression of a key as the basis of tuning. This makes it possible for the players of musical instruments to listen to a chord consisting of reference tones having tone colors of the musical instruments so as to recognize the establishment of a harmony. Furthermore, the present embodiment selects roots or overtones of musical tones subjected to extraction from output signals of the microphone 15 on the basis of the relationship between the overtones of the reference tones having different tone colors, thus calculating pitch differences based on root frequencies or overtone frequencies. Therefore, even when plural musical tones subjected to tuning are mixed and received by the microphone 15, it is possible to appropriately extract roots or overtones (regarding musical tones subjected to tuning) from output signals of the microphone 15, whereby it is possible to produce pitch differences with respect to musical tones subjected to tuning.

The present embodiment is not restrictive and is therefore further modified in a variety of ways within the scope of the present invention, which will be described below.

Figure 6:
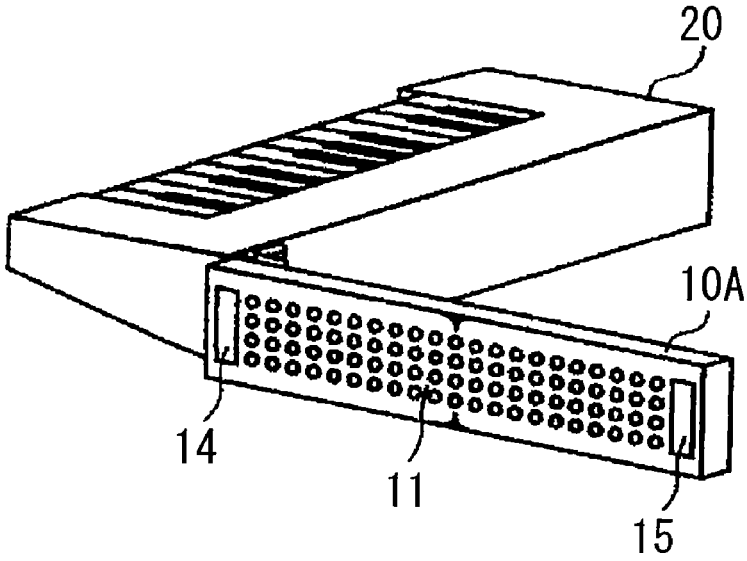
FIG. 6 is a perspective view showing a first variation of the electronic musical instrument.

(1) As shown in FIG. 6, all of the display 11, the LCD 14, and the microphone 15 are integrally arranged so as to form a rear unit 10A, which is attached to the backside 20 of an electronic musical instrument in a freely rotatable manner via hinges. This variation is advantageous in that the user can adjust the direction or position of the rear unit 10A to suit the position of the player of a musical instrument subjected to tuning without changing the direction or position of the housing 20.

Figure 7:
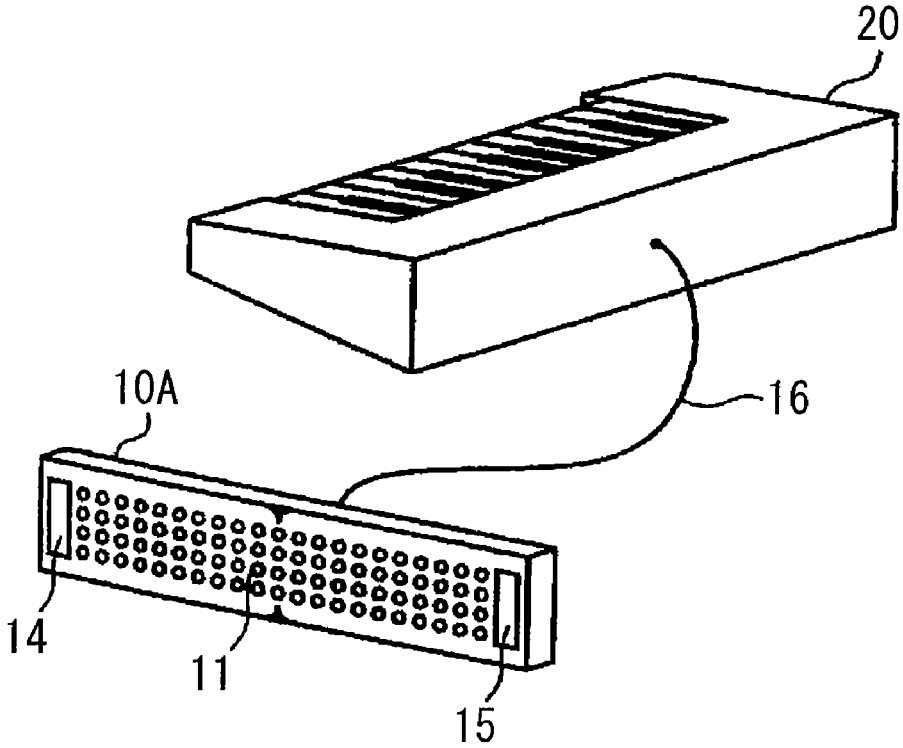
FIG. 7 is a perspective view showing a second variation of the electronic musical instrument.

(2) As shown in FIG. 7, the rear unit 10A can be detachably attached to the backside of the housing 20 of an electronic musical instrument, wherein the rear unit 10A and the housing 20 are connected together via a cable 16. Hence, electric power is supplied to the rear unit 10A via the cable 16, and electric signals are sent and received between the rear unit 10A and various parts and components of the housing 20 via the cable 16. This variation is advantageous in that the user can appropriately adjust the direction of the rear unit 10A toward the player of a musical instrument subjected to tuning irrespective of the direction of an electronic musical instrument.

(3) The present embodiment is designed such that after plural reference tones are sequentially designated so as to form a chord, the reference tones are produced in the designated tone colors. Alternatively, plural reference tones forming a chord are produced in the designated tone colors, whereas plural reference tones not forming a chord are sequentially produced in the prescribed tone color (e.g., organ). In this case, m reference tones forming a chord are simultaneously depressed, and keycodes KC-k (where k=1 to m) and tone color codes TC-k (where k=1 to m) are sequentially assigned to m reference tones in a pitch ascending order so as to control generation of the reference tones and to calculate pitch differences with respect to musical tones subjected to tuning. This variation is advantageous in that calculation processing can be simplified.

(4) The present embodiment is designed such that the reference tones are produced in the same tone colors as the musical tones subjected to tuning. Alternatively, the reference tone switches 5-k (where k=1 to 4) and the tone color switches 3 are used only for the designation of tone colors with respect to musical tones subjected to tuning, whereby prescribed tone colors can be designated for the reference tones irrespective of the musical tones subjected to tuning.

Lastly, the present invention is not necessarily limited to the present embodiment and its variations; hence, it can be further modified within the scope of the invention defined by the appended claims.

The invention claimed is:

1. An electronic musical instrument having a tuning device, comprising:

a keyboard having a plurality of keys for designating a plurality of reference tones;

a tone generator for generating the plurality of reference tones, which are designated by operating the keyboard;

a microphone for acoustically collecting a plurality of musical tones that are simultaneously generated by other instruments;

a measurement unit for measuring pitch differences between each one of the-plurality of musical tones and corresponding ones of the plurality of reference tones; and a display, which is arranged in a backside of a housing so as to display the pitch differences concerning each musical tone measured by the measurement unit.

2. The electronic musical instrument having a tuning device according to claim 1, wherein the display is detachably attached to the backside of the housing in a freely rotatable manner.

3. The electronic musical instrument having a tuning device according to claim 1, further comprising a plurality of tone color switches for designating at least one of a plurality of tone colors with respect to at least one of the plurality of musical tones subjected to tuning, wherein the plurality of musical tones are received simultaneously by the microphone and each of the plurality of musical tones are extracted by the measurement unit in correspondence with the plurality of tone colors, so that the measurement unit measures a plurality of pitch differences between the plurality of reference tones and the plurality of musical tones, whereby the display displays the plurality of pitch differences in comparison with each other.

4. The electronic musical instrument having a tuning device according to claim 1, further comprising a plurality of tone color switches for designating at least one of the plurality of tone colors with respect to at least one of the plurality of musical tones subjected to tuning, wherein the tone generator generates the plurality of reference tones having the plurality of tone colors, wherein the plurality of musical tones are simultaneously received by the microphone and each of the plurality of musical tones are extracted by the measurement unit in correspondence with the plurality of tone colors, so that the measurement unit measures a plurality of pitch differences between the plurality of reference tones and the plurality of musical tones, whereby the display displays the plurality of pitch differences in comparison with each other.

5. The electronic musical instrument having a tuning device according to claim 1, further comprising a plurality of tone color switches for designating at least one of the plurality of tone colors in advance, and wherein the tone generator sequentially generates the plurality of reference tones each having at least one of the plurality of tone colors, which are sequentially selected, with respect to the plurality of musical tones subjected to tuning, and wherein the plurality of musical tones are simultaneously received by the microphone and each of the plurality of musical tones are extracted by the measurement unit in correspondence with the plurality of tone colors, so that the measurement unit measures a plurality of pitch differences between the plurality of reference tones and the plurality of musical tones, whereby the display displays the plurality of pitch differences in comparison with each other.

6. The electronic musical instrument having a tuning device according to claim 2, further comprising a plurality of tone color switches for designating at least one of the plurality of tone colors with respect to at least one of the plurality of musical tones subjected to tuning, wherein the plurality of musical tones are simultaneously received by the microphone and each of the plurality of musical tones are extracted by the measurement unit in correspondence with the plurality of tone colors, so that the measurement unit measures the plurality of pitch differences between the plurality of reference tones and the plurality of musical tones, whereby the display displays the plurality of pitch differences in comparison with each other.

7. The electronic musical instrument having a tuning device according to claim 2, further comprising a plurality of tone color switches for designating at least one of the plurality of tone colors with respect to at least one of the plurality of musical tones subjected to tuning, wherein the tone generator generates the plurality of reference tones having the plurality of tone colors, wherein the plurality of musical tones are simultaneously received by the microphone and each of the plurality of musical tones are extracted by the measurement unit in correspondence with the plurality of tone colors, so that the measurement unit measures the plurality of pitch differences between the plurality of reference tones and the plurality of musical tones, whereby the display displays the plurality of pitch differences in comparison with each other.

8. The electronic musical instrument having a tuning device according to claim 2, further comprising a plurality of tone color switches for designating at least one of the plurality of tone colors in advance, wherein the tone generator sequentially generates the plurality of reference tones each having at least one of the plurality of tone colors, which are sequentially selected, with respect to the plurality of musical tones subjected to tuning, and wherein the plurality of musical tones are simultaneously received by the microphone and each of the plurality of musical tones are extracted by the measurement unit in correspondence with the plurality of tone colors, so that the measurement unit measures the plurality of pitch differences between the plurality of reference tones and the plurality of musical tones, whereby the display displays the plurality of pitch differences in comparison with each other.

* * * * *